US011634303B2

(12) United States Patent
Weg et al.

(10) Patent No.: US 11,634,303 B2
(45) Date of Patent: Apr. 25, 2023

(54) ELEVATOR CAR AND METHOD OF MAKING SAME

(71) Applicants: Johannes Weg, Dillenburg (DE); Christian Kolb, Breitscheid (DE)

(72) Inventors: Johannes Weg, Dillenburg (DE); Christian Kolb, Breitscheid (DE)

(73) Assignee: HAILO WIND SYSTEMS GMBH & CO. KG, Haiger (DE)

( * ) Notice: Subject to any disclaimer, the term of this patent is extended or adjusted under 35 U.S.C. 154(b) by 120 days.

(21) Appl. No.: 16/573,595

(22) Filed: Sep. 17, 2019

(65) Prior Publication Data

US 2020/0087114 A1 Mar. 19, 2020

(30) Foreign Application Priority Data

Sep. 18, 2018 (EP) ..... 18195252

(51) Int. Cl.
*B66B 11/02* (2006.01)

(52) U.S. Cl.
CPC ..... *B66B 11/0226* (2013.01)

(58) Field of Classification Search
CPC . B66B 11/0226; B66B 11/005; B66B 13/303; B66B 11/0206; B66B 11/02
See application file for complete search history.

(56) References Cited

U.S. PATENT DOCUMENTS 5,372,072 A * 12/1994 Hamy ..... B61B 13/04 104/119
2009/0294219 A1* 12/2009 Oliphant ..... B66B 9/187 187/242
2011/0266096 A1* 11/2011 Nies ..... B66B 9/16 187/251
2014/0158472 A1* 6/2014 Santos ..... B66B 11/0226 187/401
2014/0305748 A1* 10/2014 Kere ..... B66B 11/0226 187/401
2016/0159614 A1* 6/2016 Haapaniemi ..... B66B 11/009 187/254

(Continued)

FOREIGN PATENT DOCUMENTS

DE 102009005000 A1 * 12/2010 ..... B66B 11/0226
DE 202014000058 U1 * 4/2015 ..... F03D 80/80

(Continued)

OTHER PUBLICATIONS

Schiese et al., Plastic Elevator Cabin for Elevator, Dec. 2, 2010, English translation of the description of DE 102009005000 A1 (Year: 2010).*

(Continued)

*Primary Examiner* — Michael R Mansen
*Assistant Examiner* — Michelle M Lantrip
(74) *Attorney, Agent, or Firm* — Andrew Wilford

(57) ABSTRACT

An elevator car for transporting people and goods and having a floor panel, at least three side panels, and a roof panel together forming a door opening. The floor panel, at least one side panel, and the roof panel are unitarily formed of a thermoplastic synthetic resin. A force-spreading element substantially more rigid than the panels is fixed in or on an face of one of the side panels or the roof panel. A hoist system for the car is fixed by fasteners to the load-spreading element.

10 Claims, 3 Drawing Sheets

(56) References Cited

U.S. PATENT DOCUMENTS

| | | | | |
|---|---|---|---|---|
| 2018/0237326 | A1* | 8/2018 | Fredholm | B32B 17/10082 |
| 2018/0370769 | A1* | 12/2018 | Haivala | B66B 11/0206 |
| 2020/0131786 | A1* | 4/2020 | Legua Gracia | E04G 3/243 |

FOREIGN PATENT DOCUMENTS

| | | | | | |
|---|---|---|---|---|---|
| JP | 10101279 | A | * | 4/1998 | |
| JP | 2856317 | B2 | * | 2/1999 | B66B 11/0226 |
| JP | H11343083 | A | * | 12/1999 | B66B 11/02 |
| JP | 3305962 | B2 | * | 7/2002 | |
| WO | WO-2011054833 | A1 | * | 5/2011 | B66B 11/0246 |
| WO | WO-2015033017 | A1 | * | 3/2015 | B66B 7/06 |
| WO | WO-2017127005 | A1 | * | 7/2017 | B66B 7/06 |

OTHER PUBLICATIONS

Takaishi, Shigeru, Elevator Car Device, Apr. 21, 1998, Machine Translation of JP H10101279 A (Year: 1998).*

* cited by examiner

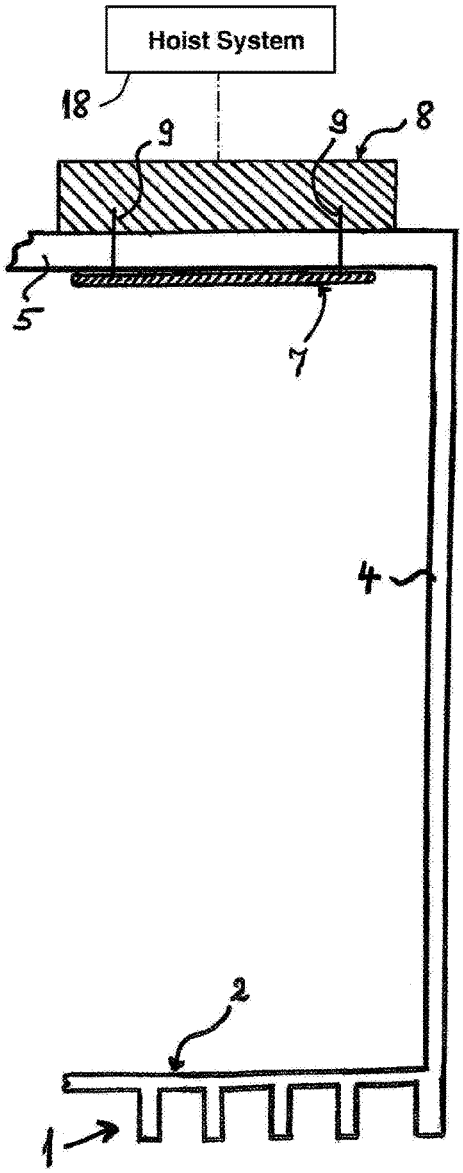
Fig. 3
Fig. 4
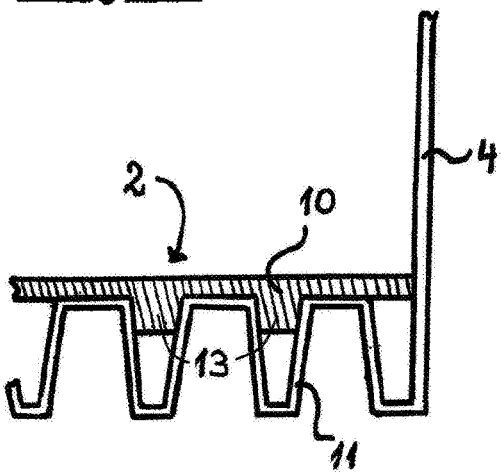
Fig. 5
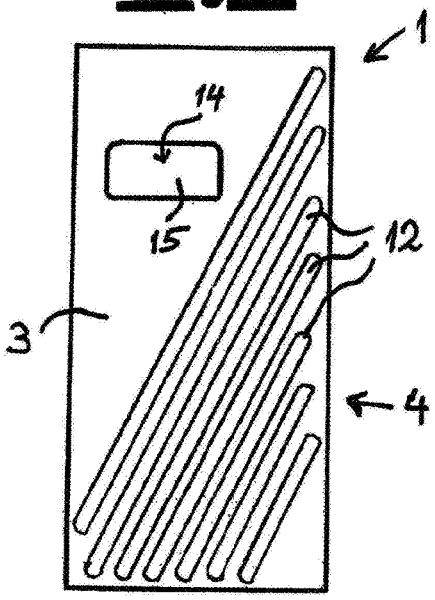

ELEVATOR CAR AND METHOD OF MAKING SAME

FIELD OF THE INVENTION

The present invention relates to an elevator of the type used at a construction site for transporting people and/or goods, particularly in wind turbines as well, or in the course of the construction of wind turbines. More particularly this invention concerns an elevator car and method of making same.

BACKGROUND OF THE INVENTION

A typical elevator care for transporting people and goods has a plurality of side panels including a floor panel, at least three side panels and a roof panel that together form a door opening. Such an elevator car is typically moved vertically by a hoist system that is connected to the elevator car.

The known elevator cars are generally made of metallic materials or at least substantially of metallic materials. Here, the load-bearing structure is provided primarily by metallic load-bearing elements into which the forces are loaded and out of which they are unloaded. The car itself has substantially the function of a protective cover for preventing injury to the transported persons or for protecting against falling objects. It is known in principle to manufacture individual elevator components of plastic, but they are then fiber composites or fiber-reinforced plastics. This involves high costs, apart from the fact that these composites are difficult to recycle.

OBJECTS OF THE INVENTION

It is therefore an object of the present invention to provide an improved elevator car.

Another object is the provision of such an improved elevator car that overcomes the above-given disadvantages, in particular that is relatively inexpensive to make, with which any loads or forces that might arise can also be withstood and spread in a functionally reliable manner, and that also offers optimal recyclability.

Another object of the invention is to provide an improved method of making such an elevator car.

SUMMARY OF THE INVENTION

An elevator car for transporting people and goods and has a floor panel, at least three side panels, and a roof panel. At least one side panel, the floor panel, and the roof panel are unitarily formed of a thermoplastic synthetic resin. A force-spreading element substantially more rigid than the panels is fixed in or on one of the side panels or the roof panel. At least one fastener fixes the force-spreading element to a hoist system for moving and/or arresting the car.

In the context of the invention, the fact that at least one side panel, the floor panel and/or at least one side panel and/or the roof panel, is composed substantially of at least one thermoplastic synthetic resin means, in particular, that the thermoplastic synthetic resin constitutes at least 85%, preferably at least 90%, and more preferably at least 95% of the volume of this side panel. For this volume specification, it is expedient to disregard a force-spreading element imbedded in the side panel and any fasteners connected thereto. In the context of one embodiment of the invention, the fact that the floor panel is made of at least one thermoplastic synthetic resin or is composed substantially of at least one thermoplastic synthetic resin means, in particular, that at least one or exactly one planar floor component of the floor panel, which preferably extends over the entire surface of the floor panel or substantially over the entire surface of the floor panel, is made of thermoplastic synthetic resin or is composed substantially of thermoplastic synthetic resin.

It lies within the scope of the invention for the forces acting on the elevator car to be absorbed by the car itself as a supporting structure and spread via the at least one force-spreading element into the hoist system or conveying and/or arresting device. The plastic structure of the elevator car itself thus forms a supporting structure for receiving and spreading the forces or forces acting on the car. Instead of the term "force-spreading element," the term "force-transferring element" could also be used. According to one embodiment, the elevator car is moved, more particularly moved vertically, by means of a hoist system in the form of a hoisting winch or in the form of a rope traction hoist. According to another embodiment, the elevator car is moved, more particularly moved vertically, by means of a hoist system that engages a rack with a pinion.

Furthermore, it lies within the scope of the invention for the elevator car according to the invention to be rectangular in cross section and preferably parallelepipedal. Recommendably, the elevator car has a floor panel, three side panels, and a roof panel, as well as a door opening on one side. The side panels are expediently oriented relative to the roof panel so as to be perpendicular or substantially perpendicular to the floor panel. Furthermore, two respective side panels form an angle of 90° or approximately 90°. It also lies within the scope of the invention for the surface area of each of the side panels to be greater than the surface area of the floor panel and/or of the surface area of the roof panel. In principle, however, other configurations of the elevator car are possible here. According to one design variant, the elevator car is round in cross section, particularly circular or oval-shaped in cross section. In this case, the at least three side panels of the elevator car are made of side panels that are curved in cross section, particularly of side panels that are partially circular or partially oval in cross section. This cross-sectionally arcuate configuration would then be expediently adopted at least for the rear side panel and for the two lateral side panels.

One especially recommended embodiment of the invention is characterized in that the thermoplastic synthetic resin of the side panels of the elevator car is a polyolefin and particularly a polyethylene and/or a polypropylene. Polyethylene is especially preferred as the material. According to another embodiment, the thermoplastic synthetic resin of the side panels of the elevator car is a polyamide. According to one embodiment of the invention, the terms "polyethylene," "polypropylene," or polyamide also refer to copolymers of polyethylene, polypropylene or polyamide.

According to a very preferred embodiment of the invention, the load is spread via at least one force-spreading element that is on or in a side panel. Advantageously, the load is spread via at least one force-spreading element that is on or in the roof panel and/or via at least one force-spreading element that is on or in at least one side panel, preferably the rear side panel. In principle, one or at least one force-spreading element can also be arranged on or in the floor panel. In the context of the invention, the expression "rear side panel" refers particularly to the side panel that is opposite the door opening of the elevator car.

One especially preferred embodiment that has very special significance in the context of the invention is characterized in that the force-spreading element is imbedded in the plastic of a side panel of the elevator car. According to the recommended embodiment of the invention, the at least one force-spreading element is imbedded in the plastic of at least one side panel, preferably the rear side panel. Expediently, the at least one force-spreading element or the exactly one force-spreading element is surrounded, particularly completely surrounded or substantially completely surrounded, by the plastic of the side panel. In the context of this embodiment, the at least one force-spreading element or the exactly one force-spreading element is preferably surrounded by the plastic of the at least one side panel, expediently the rear side panel, particularly completely surrounded or substantially completely surrounded. According to another design variant of the invention, the at least one force-spreading element is under the roof panel or directly below the roof panel. In this case, the at least one force-spreading element preferably bears positively against the lower face of the roof panel, more particularly against the plastic of the roof panel.

It lies within the scope of the invention for the force-spreading element to be composed at least substantially of a material that is different from the thermoplastic synthetic resin of the side panel or side panels. The force-spreading element is preferably of metal or substantially of metal. According to another design variant, the force-spreading element could be composed or substantially made of a reinforced plastic, particularly of a fiber-reinforced plastic.

In principle, the force-spreading element can have different shapes. Thus, the force-spreading element could be embodied merely as a threaded insert that is preferably imbedded in the plastic of the associated side panel of the car. The force-spreading element could also be embodied as a force-spreading bar that is connected to the associated side panel or, according to a very preferred embodiment, imbedded in the associated side panel. It lies within the scope of the invention for the at least one force-spreading element to extend over at least a portion of the surface of the associated side panel of the car. This enables the force-spreading element to be incorporated as a threaded insert that is imbedded in the side panel with fixing struts connected thereto that preferably extend into the plastic of the side panel and thus ensure a planar expansion of the force-spreading element. In this embodiment, a plurality of threaded inserts is expediently imbedded in the side panel and/into the plastic of the side panel, and these threaded inserts are preferably connected to the hoist system or to the conveying and/or arresting device by fasteners.

One very especially preferred embodiment of the invention is characterized in that the at least one force-spreading element is a planar force-spreading element and is preferably embodied as a force-spreading plate or as a force-spreading grate or the like. In this case, the planar force-spreading element, particularly the force-spreading plate and/or the force-spreading grate, is connected in a planar manner to the associated side panel and/or integrated in a planar manner into the plastic of the associated side panel. Recommendably, the planar force-spreading element, particularly the force-spreading plate and/or the force-spreading grate, is connected in a planar manner to the associated roof panel and/or to the associated side panel, particularly to the rear side panel. Very preferably, the planar force-spreading element, particularly the force-spreading plate and/or the force-spreading grate, is imbedded in the plastic of the associated roof panel and/or into the plastic of the associated side panel, particularly of the rear side panel. At the same time, the planar force-spreading element is preferably arranged so as to be parallel or substantially parallel to the surface of the associated side panel or of the associated roof panel and/of or the associated side panel.

It lies within the scope of the invention for a force-spreading element to be connected by at least one fastener, preferably by a plurality of fasteners, to the hoist system or to the conveying and/or arresting device. The fastener or fasteners preferably engages or engage through the plastic of the associated side panel, preferably the plastic of the associated roof panel and/or the plastic of the associated side panel, particularly of the rear side panel. Recommendably, the fasteners are embodied as metallic fasteners. Expediently, they extend transverse and preferably perpendicular or substantially perpendicular to the surface of the respective side panel or to the surface of the roof panel and/or to the surface of the associated side panel. The fasteners may particularly be connecting rods, connecting bolts, connecting screws, and the like. Above all, when threaded inserts are used in the context of the invention as force-spreading elements, the fasteners are preferably embodied in the form of threaded rods, connecting screws, or the like.

A particularly recommended embodiment is characterized in that the flat force-spreading element, in particular the force-spreading plate, is only partly embedded in the side panel of thermoplastic synthetic resin, in particular in a rear side panel of thermoplastic synthetic resin, and the force-spreading element is covered on its side face into the car by the plastic of the side panel and most of its face turned outward, in particular all of this face, is not covered by the plastic of the side panel. Preferably the flat load-spreading element, in particular the force-spreading plate, is completely imbedded in the synthetic resin of the side panel and is only left uncovered by the plastic of the side panel on its outer side turned away from the car over at least most of its surface area, preferably over its entire surface area. It lies within the scope of the invention that the force-spreading plate has two opposite faces and side edges. Preferably inwardly directed face and the edges are covered by the plastic of the side panel of the car and only the second outwardly directed face is not covered by the plastic of the side panel.

According to a particularly preferred embodiment of the invention the equipment for moving and/or stopping is provided inside the car. In this case the flat force-spreading element or force-spreading plate is connected through the plastic of the side panel by a fastener or a plurality of fasteners to the moving and/or stopping equipment inside the car. It is therefore in the scope of the invention that the one or more fasteners engage with play through the side panel. Preferably each fastener extends through a sleeve imbedded in the plastic of the side panel with play. In this manner forces are transferred directly between the car and the moving and/or stopping equipment and the force-spreading element or plate and not indirectly via the side panel. In accordance with this embodiment the equipment for moving and/or stopping inside the car. This equipment for moving and/or stopping preferably is a hoist winch. The moving and arresting equipment can be combined as a single unit or separate moving and stopping devices can be in the car and preferably on the flat force-spreading element or plate.

One recommended embodiment of the invention is characterized in that the floor panel of the car forms or has a load-receiving surface of the car, and that spreading of the load and/or force to the at least one force-spreading element occurs only or at least substantially via the car made of thermoplastic synthetic resin. According to a preferred embodiment of the invention, apart from the connection of the floor panel to the at least one force-spreading element via the thermoplastic synthetic resin of which the car is composed, there are no further connecting components such as struts, supports, rods, and the like between the floor panel and the at least one force-spreading element.

One embodiment of the invention that has proven to be advantageous is characterized in that the floor panel has at least one or exactly one planar load distribution component that spreads the load into the car made of thermoplastic synthetic resin. In this case, the planar load distribution component is preferably supported on at least one support component, particularly on a planar support component of the floor panel. It lies within the scope of the invention for the load distribution component and/or the support component of the floor panel to extend over the entire surface of the floor panel or over substantially the entire surface of the floor panel. The planar support component of the floor panel preferably has support elements that project outward or inward with respect to the surface of the support component, particularly in the form of support ribs and/or support beads and/or support nubs, by virtue of which support elements the strength and/or stability of the floor panel is preferably increased. According to a recommended embodiment of the invention, the planar load distribution component of the floor panel engages positively in the planar support component of the floor panel. It is preferred that the planar load distribution component of the floor panel have on its lower face interlocking elements that engage in complementary interlocking elements of the planar support component of the floor panel. According to one recommended embodiment of the invention, the planar load distribution component of the floor panel is made of metal or substantially of metal and the support component or the planar support component of the floor panel is preferably made of the thermoplastic synthetic resin or substantially of the thermoplastic synthetic resin.

In principle, it is possible for the floor panel to be embodied in various ways in the context of the invention. For example, it can be at least one support strut, support grate, or the like. The at least one support component can be made of plastic and/or of metal or substantially of plastic and/or substantially of metal. According to one design variant of the invention, the floor panel and/or the planar load distribution component of the floor panel is made of at least one plastic and at least one support component, which can be made of metal, sits on the floor panel and/or the planar load distribution component. Expediently, this at least one metal support component is integrated at least partially into the plastic of the floor panel and/or into the plastic of the planar load distribution component. Thus, the at least one metal support component can be rotated into the plastic of the floor panel and/or into the plastic of the load distribution component as part of a plastic rotation process. According to one recommended embodiment, a plurality of support components protrudes from the lower face of the floor panel and/or from the lower face of the planar load distribution component of the floor panel, in which case these support components are expediently embodied as metallic support components and partially integrated, particularly rotated, into the plastic of the floor panel and/or into the plastic of the load distribution component.

One very especially preferred embodiment of the invention is characterized in that an assembly of at least the floor panel or at least one component of the floor panel and at least one side panel connected thereto, preferably of a plurality of side panels connected thereto, is fabricated as an integral or one piece unit of thermoplastic synthetic resin. The floor panel and floor panel component (particularly the planar support component of the floor panel) and the side panel or the side panels then form one piece of thermoplastic synthetic resin. In this case, at least one force-spreading element is preferably embedded in at least one side panel, and fasteners are expediently connected to this force-spreading element, said fasteners being preferably connected to the hoist system or to the conveying and/or arresting device. It has proven advantageous if two and preferably three side panels with the floor panel or with at least one component of the floor panel form one piece made of thermoplastic synthetic resin. One very especially preferred embodiment of the invention is characterized in that an assembly of the floor panel or at least one component of the floor panel and at least one side panel connected thereto, particularly of a plurality of side panels connected thereto, and of the floor panel form an integral or one piece unit of thermoplastic synthetic resin. Preferably, at least one unit is formed from the floor panel or at least one component of the floor panel and at least from the rear side panel and from the roof panel as an integral or one piece unit made of thermoplastic synthetic resin.

One highly recommended embodiment that has very special significance in the context of the invention is characterized in that an assembly of the floor panel or at least one component of the floor panel and three side panels and the roof panel is fabricated as an integral or one-piece unit made of thermoplastic synthetic resin. As a matter of principle, the car can also have a modular construction instead of the one-piece construction of the elevator car according to the invention. This means that the individual side panels, particularly of thermoplastic synthetic resin, are combined and/or interconnected in order to form the car. For example, the floor panel, the side panels, and the roof panel can be assembled as modular components of the elevator car in order to form the complete elevator car.

According to one recommended design variant, at least one side panel and preferably one side panel of the elevator car according to the invention has reinforcing elements that are distributed over its wall surface and/or side panel surface, particularly reinforcing ribs and/or reinforcing beads that are distributed over the side panel surface. The reinforcing elements can thus be reinforcing ribs that emerge from the respective side panel surface and/or reinforcing beads that are embedded in the respective side panel surface. In this respect, the invention is based on the discovery that the load-bearing cross-sectional area can be effectively increased by the reinforcing elements that are introduced into the side panel surface.

It lies within the scope of the invention for the door opening of the car to be closeable and, in particular, closeable by a door. One very especially preferred embodiment of the invention is characterized in that fixation elements and/or stop elements for the car door are provided on and/or in the side panels made of thermoplastic synthetic resin and/or on and/or in the roof panel made of thermoplastic synthetic resin and/or on and/or in the floor panel made of thermoplastic synthetic resin. The fixing elements and/or stop elements for the car door are expediently imbedded in the plastic of the respective side panel. One embodiment of the invention that has proven advantageous is characterized in that the car door is embodied as a roller blind, particularly as a slat or accordion gate. Other embodiments of the car door for the elevator car according to the invention are conceivable in principle.

One embodiment of the invention is characterized in that the wall thickness of at least one side panel is increased in the region of the force-spreading element. According to one design variant, this is the side panel on which or in which the force-spreading element is, and the thickness of this side panel increases at and around the force-spreading element. Alternatively or in addition, the thickness of at least one side panel that is connected to the side panel with the force-spreading element increases at the force-spreading element and/or at the side panel with the force-spreading element. In the embodiments described above, it is recommended that the thickness of the at least one side panel increase by at least 50%, preferably by at least 75%, and more preferably by at least 90%. In principle, it lies within the scope of the invention for the thickness of at least one side panel and/or the thickness of at least one region of at least one side panel be established as a function of the load to be spread in this side panel.

According to one design variant of the invention, at least one side panel, preferably at least one side panel of the elevator car, has a gap or an opening, this gap or opening being expediently sealed by a removable plate, particularly by a removable transparent plate. Preferably, the gap or the opening is designed such that maintenance and/or cleaning and/or repair work can be performed from within the car to the outside after removal of the plate or the transparent plate. Another design variant of the invention is characterized in that a viewing opening is formed in the floor panel, and this viewing opening can be at least partially sealed by the planar load distribution component of the floor panel.

The invention also relates to a method of making an elevator car, whereby the elevator car is fabricated from a plurality of side panels, particularly from side panels in the form of a floor panel, side panels, and a roof panel, with at least one side panel, preferably a plurality of side panels, being formed by a plastic molding process, particularly by plastic rotational casting and/or by plastic blow-molding. It lies within the scope of the invention for an assembly of at least two side panels, preferably of at least three side panels, more preferably of at least four side panels, and particularly of at least five side panels or of exactly five side panels be fabricated as an integral or one piece unit. It also lies within the scope of the invention for the side panels or the assembly of the side panels to be made of at least one thermoplastic synthetic resin, preferably at least one polyolefin, and more preferably made polyethylene and/or polypropylene. Polyethylene is very especially preferred as a material. In principle, it is also possible to use polyamide as the thermoplastic synthetic resin for the side panels or for the assembly.

It was already pointed out above that, according to a preferred embodiment, the thickness of at least one side panel is increased in the region of the force-spreading element. In the context of a plastic molding method that is used according to the invention, the wall thickness of at least one side panel can be established in a simple manner as a function of the load spread by controlling the heat input with or without feedback. A plastic molding method that is used according to the invention is especially advantageous in this respect as well.

The invention is based on the discovery that the elevator car according to the invention can be manufactured in a simple, inexpensive, and cost-effective manner. It is of special importance that side panels of the elevator car or preferably all side panels of the elevator car be made of thermoplastic synthetic resin or be composed substantially of thermoplastic synthetic resin. Nevertheless, effective spreading of loads and/or forces can be achieved, particularly even in an elevator car of low weight or low mass. The elevator car can be safely moved in an elevator shaft, and there are no disadvantages relative to conventional elevator cars. In addition to the relatively simple and cost-effective manufacturing of the elevator car according to the invention, it should also be emphasized that the components of the elevator car are characterized by excellent recyclability. Moreover, the elevator car according to the invention also represents a unit that satisfies all requirements from a production engineering perspective in terms of strength and is distinguished by sufficient resistance to mechanical influences.

BRIEF DESCRIPTION OF THE DRAWING

The above and other objects, features, and advantages will become more readily apparent from the following description, reference being made to the accompanying drawing in which:

FIG. 3 is a second embodiment of the detail of FIG. 2;

FIG. 4 is a section through a lower region of the elevator car according to the invention;

FIG. 5 is an elevational view of a side panel of the elevator car;

SPECIFIC DESCRIPTION OF THE INVENTION

Figure 1:
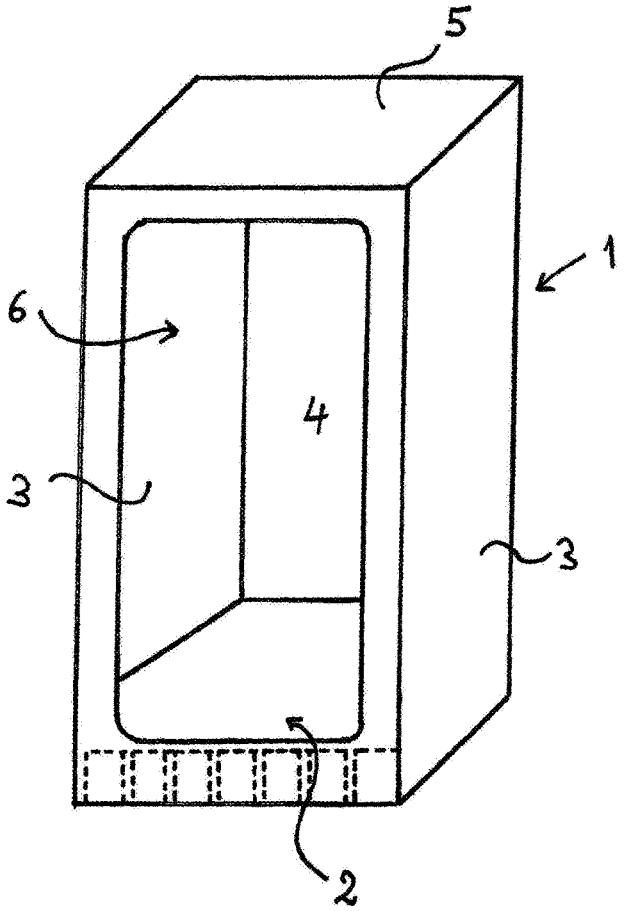
FIG. 1 is a perspective view of an elevator car according to the invention.

The drawing shows an elevator car 1 according to the invention for transporting people and goods that in this embodiment may be the elevator car 1 of a construction elevator. The elevator car 1 according to the invention can be used particularly for elevators of wind turbines or windmills, and particularly during the construction of such wind turbines or windmills. Preferably and here, the elevator car 1 has a floor panel 2, three side panels 3, 4, a ceiling panel 5, and a door opening 6. The door opening 6 enables the elevator car 1 to be entered and/or loaded. The door opening 6 is closed, preferably with a roller gate, particularly with a slats, which is not shown here.

Here, the ceiling panel 5, the three side panels 3, 4, and a support component 11 of the floor panel 2 are composed or substantially made of a thermoplastic synthetic resin. Preferably and here, the thermoplastic synthetic resin may be a polyolefin, especially preferably polyethylene. Preferably and here, the assembly of the ceiling panel 5, the three side panels 3, 4 and the support component 11 of the floor panel 2 are made as an integral or one-piece unit of thermoplastic synthetic resin. It is recommended that manufacturing be performed by plastic rotary molding or by blow-molding.

Figure 2:
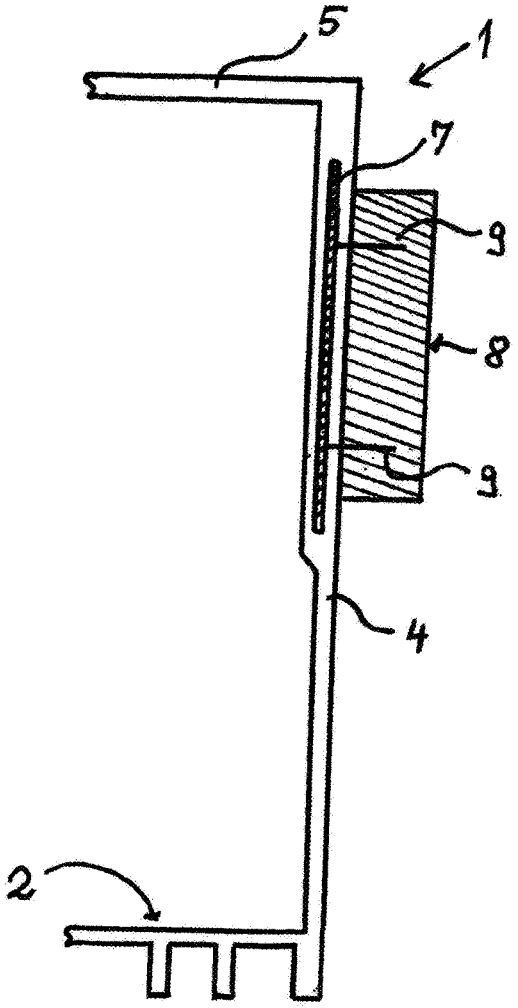
FIG. 2 is a detail of a section through the car according to FIG. 1.

Advantageously and here according to FIGS. 2 and 3, the rear side panel 4 or the ceiling panel 5 is connected to a hoist system or moving and/or arresting device 8 of the car 1 for transferring loads via a force-spreading element 7. The system 8 is employed to move the elevator car in an elevator shaft, particularly by interacting with a rail rack or the like.

According to a preferred embodiment, and here according to FIG. 2, the force-spreading element 7 is imbedded in the plastic of the rear side panel 4 and is completely surrounded by the plastic of the rear side panel 4. Preferably and here, the force-spreading element 7 is a plate. In this case, this planar plate is imbedded in the plastic of the rear side panel 4. Expediently and here, the force-spreading plate is parallel to the rear side panel 4. Recommendably, and here, the force-spreading element 7 or the force-spreading plate is made of metal.

Here according to FIG. 2, the hoist system 8 is part of the rear side panel 4 of the car 1. This rear side panel 4 is situated opposite the door opening 6 of the car 1. Preferably and here, the force-spreading element 7 in the form of a planar plate is connected to the hoist system 8 by fasteners 9. These fasteners 9 engage through the plastic of the rear side panel 4. Preferably and here, the fasteners 9 may be straight metallic threaded rods that can engage in a corresponding internal thread of the force-spreading element or plate 7.

According to another preferred embodiment, and here according to FIG. 3, the force-spreading element 7 is underneath the ceiling panel 5, more particularly beneath the plastic ceiling panel 5. The force-spreading element 7 is also preferably embodied here as a planar force-spreading element 7 in the form of a force-spreading plate that rests directly against the lower face of the ceiling panel 5. The force-spreading plate is parallel to the ceiling panel 5. In the embodiment according to FIG. 3 as well, the force-spreading element or plate 7 is connected by the fasteners 9 to the hoist system 8 that is above the ceiling panel 5. These fasteners 9 also engage through the plastic of the ceiling panel 5. Here according to FIG. 3, the ceiling panel 5 is clamped between the hoist system 8 and the force-spreading element or plate 7. Here, too, the fasteners 9 engaging through the plastic of the ceiling panel 5 are straight fasteners 9 and, in particular, metallic threaded rods.

It lies within the scope of the invention for the floor panel 2 to form or have the load-receiving surface of the car 1 and for spreading of the load and/or force from the thermoplastic synthetic resin to the force-spreading element to occur substantially via the, preferably integrally formed, car 1. FIG. 4 shows an especially preferred embodiment of the floor panel 2 for the elevator car 1 according to the invention. Here, the floor panel 2 has a planar load distribution component 10 via which the load is transferred from the thermoplastic synthetic resin into the car 1. Preferably and here according to FIG. 4, the planar load distribution component 10 is supported on a planar support component 11 of the floor panel 2. Preferably and here, the planar load distribution component 10 is embodied as a planar metallic bottom component, and the planar support component 11 is of thermoplastic synthetic resin and, preferably and here, is unitarily formed with the side panels 3 and 4 of the car 1. Expediently and here, the planar support component 11 has support ribs for reinforcement of the floor panel 2. Preferably and here, the planar load distribution component 10 engages complementarily positively with interlocking ribs 13 of the planar support component 11.

FIG. 5 shows a further proven embodiment of the invention, namely a preferred embodiment of a side panel 3 of the elevator car 1 according to the invention. Recommendably and here, this side panel 3 has reinforcing elements 12 on its surface in the form of reinforcing beads that are formed in the side panel surface. In this way, the strength of the respective side panel 3 or of the entire elevator car 1 can be increased. The reinforcing beads are molded into the thermoplastic plastic of the side panel 3. In this embodiment according to FIG. 5, the side panel 3 also has a gap or an opening 14 that can be sealed with a removable transparent plate 15. After removal of this transparent plate 15, maintenance, repair, or cleaning work can be performed from within the car 1 to the outside.

Figure 6:
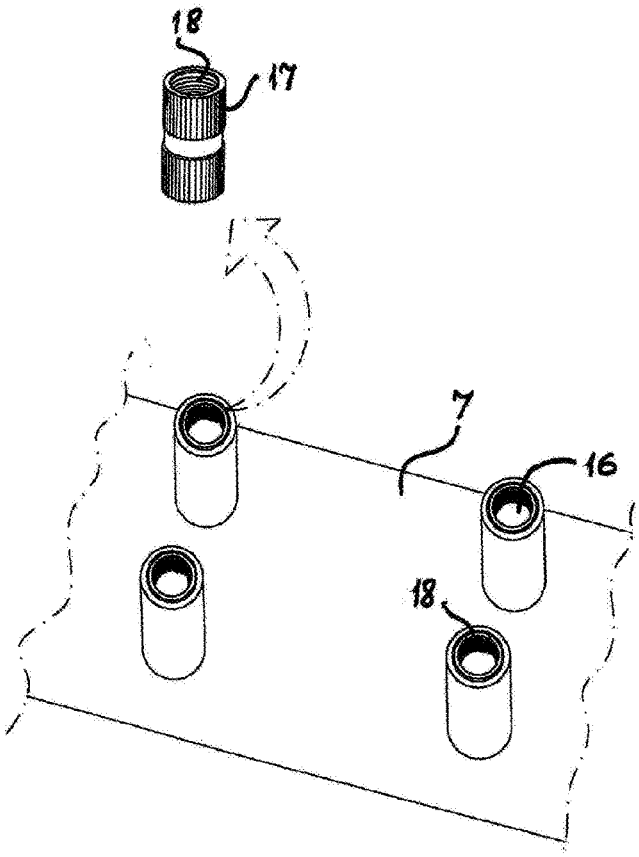
FIG. 6 is a perspective view of a force-spreading element, more particularly of a force-spreading plate of the elevator car.

FIG. 6 shows an especially preferred embodiment of the force-spreading element 7 for the elevator car 1. Expediently and here, the force-spreading element 7 is a laminar force-spreading plate that is made of metal. Preferably and here, the force-spreading element or plate 7 has a plurality of form-fitting openings 16 into which threaded inserts 17 are inserted in a form-fitting manner. Preferably and here, the threaded inserts 17 are provided with axial grooves in which axial ribs of the form-fitting openings 16 engage positively. Recommendably, and here, the threaded inserts 17 each have an internal thread 18 into which, preferably and here, a fastener 9 can be screwed for the purpose of connecting to the hoist system 8. For example, fasteners 9 in the form of linear threaded rods can be screwed into these internal threads 18 of the threaded inserts 17. The fasteners 9 are preferably imbedded in the plastic of the respective wall panel of the elevator car 1.

Figure 7:
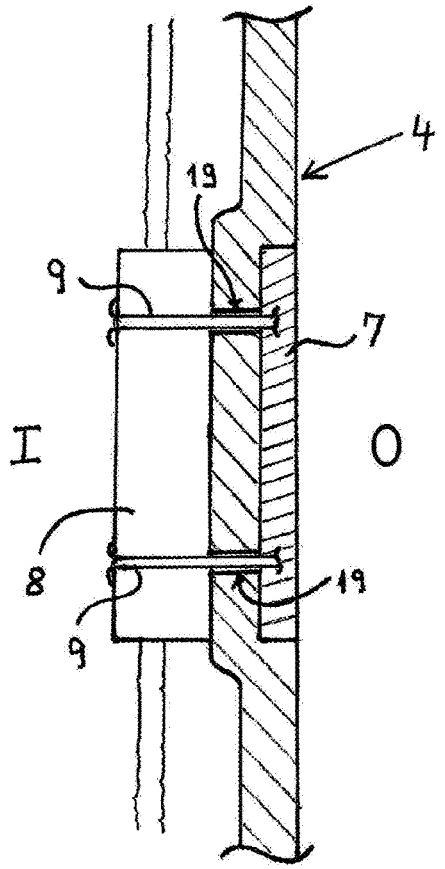
FIG. 7 is an elevational sectional view of a further embodiment of the invention.

FIG. 7 shows a particularly preferred embodiment of the invention with a part of the rear side panel 4 of the elevator car 1 seen in section. Here the force-spreading element 7 is also a force-spreading plate that preferably and here according to FIG. 7 is only partly embedded in the thermoplastic synthetic resin of the rear side panel 4. The force-spreading plate is covered on its face directed into the interior I of the car by the plastic of the rear side panel 4. Preferably and here the force-spreading plate is exposed to the outside A over its entire surface by the thermoplastic resin of the side wall and is uncovered. Preferably and here according to FIG. 7 the force-spreading plate is a rectangular force-spreading plate. It is covered on all four edges but not on the outwardly directed face by the plastic of the side panel for best unitary integration.

According to a preferred embodiment and here according to FIG. 7 the moving and/or stopping equipment is inside the car 1. Preferably and here the force-spreading plate connected via a plurality of fasteners 12 extending through the plastic of the side panel 4 with the internal moving and/or stopping equipment. Preferably and here the connectors 9 are straight, in particular bolts. Preferably and here the fasteners 9 extend with play through sleeves 19 imbedded in the plastic of the rear side panel 4. In this manner the loads or forces are transferred to the force-spreading plate.

We claim:

1. An elevator car for transporting people and goods and comprising:

a floor panel;

at least three side panels;

a roof panel, the floor, side, and roof panels together forming a door opening, at least one of the side panels, the floor panel, and the roof panel being unitarily formed of a thermoplastic synthetic resin;

a flat force-spreading laminar plate or grate substantially more rigid than the one side panel, only partially embedded in the one side panel, covered toward an interior of the car with the resin of the one side panel, and uncovered and exposed over at least most of its outer face by the resin of the one side panel; and fasteners extending through the one side panel on which the force-spreading element is fixed and fixing the force-spreading element to a hoist system for moving and/or arresting the car.

2. The elevator car defined in claim 1, wherein the hoist system is inside the car and the flat force-spreading element or the force-spreading plate is connected through the plastic of the one side panel by the fasteners to the hoist system inside the car.

3. The elevator car defined in claim 1, wherein the floor panel has an upwardly directed floor surface, the car further comprising:

a rigid support component sitting on the floor surface.

4. The elevator car defined in claim 3, the support component is planar.

5. The elevator car defined in claim 1, wherein the one side panel is opposite the door opening.

6. The elevator car defined in claim 1, wherein the plate or grate is imbedded in the side panel across from the door opening.

7. The elevator car defined in claim 1, wherein the plate or grate is made of metal.

8. The elevator car defined in claim 1, wherein all of the panels are unitarily formed in one piece of the thermoplastic synthetic resin.

9. The elevator car defined in claim 1, wherein one of the side panels is formed with reinforcing ribs and/or reinforcing beads.

10. The elevator car defined in claim 1, further comprising:

a gate or door closable over the door opening.

* * * * *